United States Patent [19]

Hardy et al.

[11] 4,132,170

[45] Jan. 2, 1979

[54] FUEL-AIR TYPE BOMB

[75] Inventors: Periam B. Hardy; Lewis L. Gay; Edward L. Husler, all of Boulder, Colo.

[73] Assignee: Beech Aircraft Corporation, Wichita, Kans.

[21] Appl. No.: 115,119

[22] Filed: Feb. 12, 1971

[51] Int. Cl.[2] ..... F42B 25/12

[52] U.S. Cl. ..... 102/6; 102/66; 102/90

[58] Field of Search ..... 102/6, 39, 66, 90; 149/89-91

[56] References Cited

U.S. PATENT DOCUMENTS

| | | | |
|---|---|---|---|
| 1,287,372 | 12/1918 | McGaw | 102/66 |
| 2,195,965 | 4/1940 | Holm | 102/39 E |
| 2,372,264 | 3/1945 | Firth | 102/6 |
| 2,445,311 | 7/1948 | Cooke et al. | 102/6 X |
| 2,445,312 | 7/1948 | Cooke et al. | 102/6 |
| 2,742,856 | 4/1956 | Fieser et al. | 102/6 |
| 3,208,891 | 9/1965 | Eschrich et al. | 149/89 X |
| 3,377,219 | 4/1968 | Stiefel et al. | 149/89 |
| 3,499,384 | 3/1970 | Zernow et al. | 102/6 |
| 3,505,957 | 11/1970 | Tichauer et al. | 102/6 |
| 3,570,401 | 3/1971 | Euker | 102/6 |
| 3,596,602 | 8/1971 | Gey et al. | 102/90 |
| 3,596,603 | 8/1971 | Gryting | 102/6 |

*Primary Examiner*—David H. Brown
*Attorney, Agent, or Firm*—Edward L. Brown, Jr.

[57] ABSTRACT

A fuel-air type bomb which contains a liquid fuel normally non-explosive, with a bursting charge centrally located within the fuel; the bursting charge, upon firing, shocks the fuel into a highly reactive mixture with the surrounding air while simultaneously disseminating the fuel at a supersonic rate over a large area, which causes increasing blast effects.

13 Claims, 2 Drawing Figures

Figure 1:
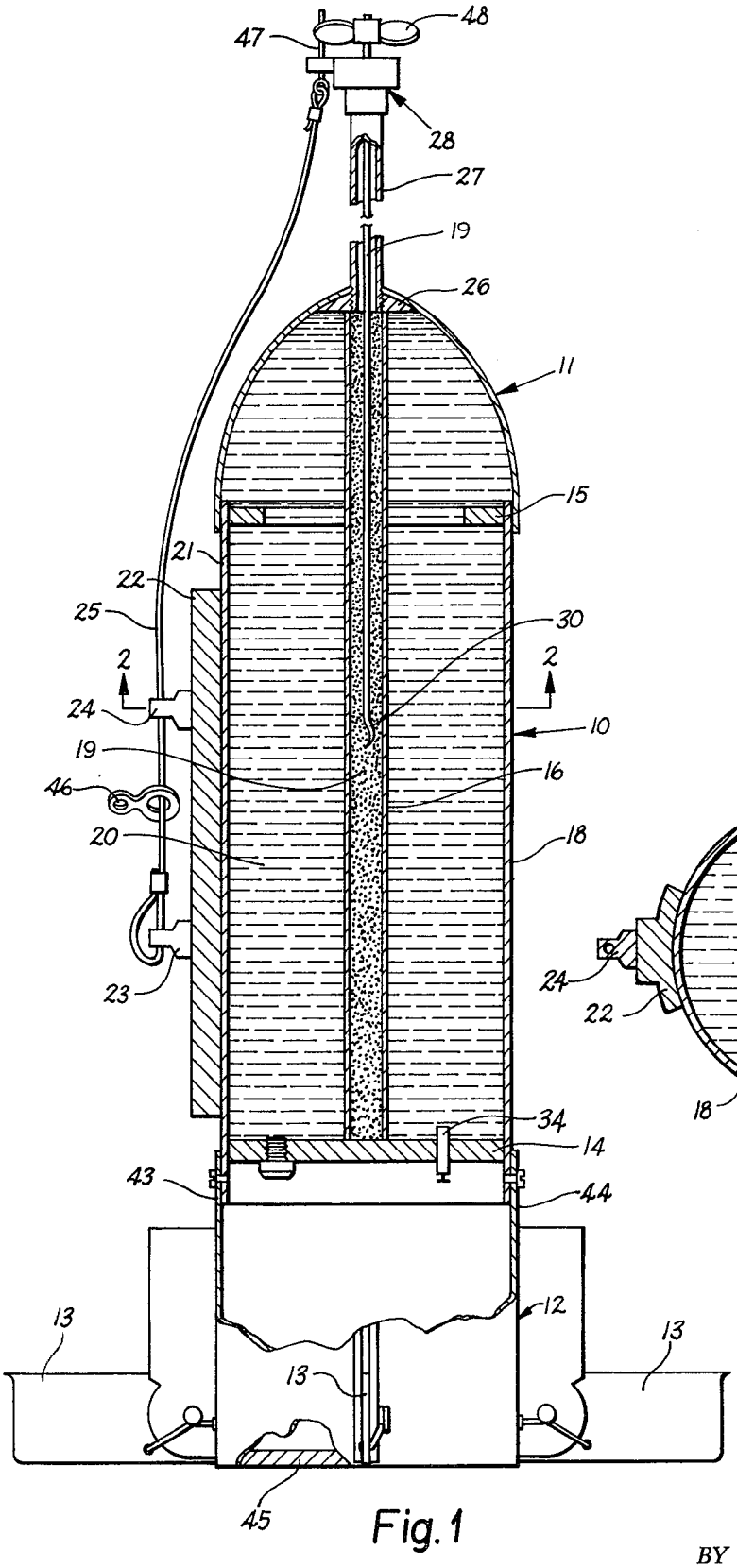

INVENTOR.
PERIAM B. HARDY
EDWARD L. HUSLER
LEWIS L. GAY
BY Miller & Brown
ATTORNEY

FUEL-AIR TYPE BOMB

This invention relates to aerially delivered destructive bombs in general, and more particularly to a bomb which will herein be referred to as a fuel-air mixture type bomb, as opposed to a bomb, the explosive power of which is provided by a concentrated highly explosive material not dependent upon an outside source of oxygen. The conventional high explosive bomb has a destructive effect over only a very limited target surface area, whereas the fuel-air bomb has a destructive effect over a much greater surface area.

BACKGROUND OF THE INVENTION

Certain Government Agencies and their contractors have in recent years produced and tested fuel-air type bombs, also known as FAE devices, all of which have had critical disadvantages. The early bombs tested have carried either pressurized propane or ethylene oxide as fuel to provide the ultimate explosive effect, when mixed with air. The fuel was dispersed into the air by means of a high brisance explosive. Fuel dispersal by means of a high brisance explosive resulted in the formation of a doughnut shaped cloud of fuel-air mixture which cannot be efficiently detonated by detonators located in its void central area. For this reason such bombs necessarily have had to carry numerous cloud detonators, together with a means for distributing these detonators into various locations within the surrounding doughnut shaped cloud prior to actuating the detonators. Since the downward velocity of travel of the bomb hardware, after fuel dispersal, is much greater than that of the doughnut shaped cloud, it has not been possible to properly distribute the detonators into the doughnut shaped fuel-air mixture without retarding the terminal velocity of the bomb. By reason of this limitation, the bombs must use a parachute or other speed retarding device prior to target impact.

Such parachute lowered bombs are subject to wind drift, enemy detection and dispersal prior to bomb detonation, hanging up in the trees, etc.

Another type of two event FAE device, covered in our U.S. patent application Ser. No. 89,140, utilizes a low brisance central burster explosive with an unpressurized monopropellant liquid fuel which is stable in the liquid state but highly explosive when atomized in the air. By using a low brisance burster charge the cloud formation is not torus shaped but rather hemispherical with a substantially uniform fuel-air density. With a uniform cloud the second event detonation can be handled with a single or dual detonator rather than the complex multiple detonator system previously mentioned.

SUMMARY OF THE INVENTION

Prior to the present invention it has been felt that to achieve a fuel-air explosion, you must first dispense the fuel in an aerosol cloud before the second event of detonation. The present invention has achieved a fuel-air explosion without the second event, under dynamic conditions. The burster explosive (first event) not only dispenses the fuel into the atmosphere but simultaneously begins the detonation of the fuel at a supersonic rate. Detonation at a rate less than supersonic causes the fuel to burn with no blast effect. What in effect happens, is an expanding fuel-air explosion is caused which spreads in size from time zero pushing the burning fuel outward into the air, culminating in a large fire ball. The overpressure effect of the explosion on the target area is equally devastating as the previously mentioned two event FAE.

In the prior art two event FAE devices there was much concern about the burster charge causing the fuel to preburn before the second event of detonation. This is of no concern in the present invention since the burster charge shocks the fuel to a sufficient degree to cause immediate detonation as the fuel is dispersed. The present invention will not function under static firing conditions with the presently used burster charges since the fuel needs the additional dispersing effect of air pressure breaking up the fuel to obtain enough oxygen for complete detonation. While the liquid fuels used are called monopropellants, they normally need some additional oxygen assistance or increased pressures and temperatures for detonation.

The single event FAE bomb eliminates any separate time delayed detonators or their related structure. Contrary to the previously mentioned two event FAE's, the greater the terminal velocity of the single event bomb, the more damaging the effect of the explosion.

At the forward end, the bomb housing carries a sequence initiating proximity fuse of any desired type, connected by prima cord or electrical detonator extending well into the burster explosive in the central chamber.

When the bomb closely approaches the target the proximity fuse is activated, igniting the bursting charge which ruptures the walls of the housing dispersing the fuel into on-rushing air with a sufficient shock to detonate the fuel at the same time.

It is therefore the principal object of the present invention to provide a single event fuel-air explosion. A further object is to provide a FAE bomb with no terminal velocity limitations.

An additional advantage is the use of a liquid fuel which is non-gaseous and stable at standard temperatures and pressures, thus eliminating the necessity of a pressurized fuel chamber.

Figure 2:
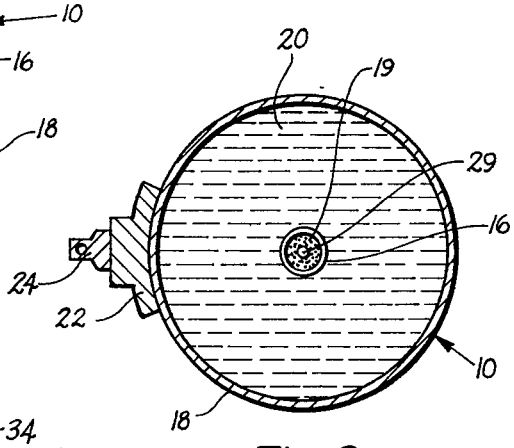

Our invention will be more clearly understood when the following description is read in connection with the accompanying drawings, in which:

FIG. 1 is a central longitudinal sectional view though a bomb embodying our invention; and FIG. 2 is a transverse sectional view of the same, taken along the plane indicated by the line 2—2 in FIG. 1.

Referring to FIG. 1 of the drawings, the illustrated preferred embodiment of our invention includes a load carrying housing designated as a whole by the numeral 10. A combination nose cone and fuse supporting member, designated as a whole by the numeral 11, is suitably secured to the forward end of the housing 10. A tail assembly rigidly secured to the aft end of housing 10 is designated as a whole by the numeral 12. The tail assembly 12 supports a plurality of outwardly spring pressed retractable stabilizing fins 13.

Housing 10 includes a rigid circular end plate 14 at one end and a circular rib 15 at its opposite end. Concentric cylindrical walls 16 and 18 have their opposite ends secured to the end plate 14 and nose cone 11 in sealed, leak tight relationship, as by welding or other means. The two walls thus define two separate, concentric sealed chambers 19 and 20. The inner wall 16 can be constructed of materials other than aluminum such as plastic, stainless steel, and brass. When utilizing certain burster explosives that can be placed directly in the fuel, the inner wall 16 can be eliminated. While the drawings only illustrate a centrally positioned burster explosive, an implosion type of charge could also be used which would surround outer wall 18.

An elongated rigid stiffener and swaybrace 22 is secured longitudinally to the exterior surface of outer housing wall 18, as shown. On its outer surface stiffener 22 carries lugs (not shown) and fixed, fore and aft aligned eyelets 23 and 24 which serve as guides for a fuse arming lanyard 25.

The forward end of the nose cone 11 centrally carries a rigidly fixed, internally threaded fitting 26, which receives and supports the inner end of a tubular fuse support 27. A conventional proximity fuse 28 is fixed on the forward outer end of the support 27.

The fuse illustrated is a standard stab detonator type, identified by the Department of Defense (Army) as an M158 fuse. Its operation is well known in the art. The fuse illustrated can be classed as a proximity fuse because it is positioned ahead of the nose of the bomb, and it is detonated by impact before the bomb housing actually contacts the target.

Furthermore, the fuse support 27 may be eliminated and an entirely different type of proximity fuse secured to the nose cone. Other suitable fuses are the Radar Proximity Fuse Mark 43 TDD, the Infra-Red Air Proximity Fuse, or the omni-directional, stab pinpercussion cap, explosive train fuse FMU 68, all of which are in common use by the Department of Defense, and are of well known construction.

Regardless of the type of fuse needed, the explosive element of the fuse is connected to a length of prima cord 29, which extends through fuse support 27, through fitting 26, and well into a body of explosive with which chamber 19 is packed. The inner end of the prima cord fuse train is designated by numeral 30.

The explosive burster charge utilized in chamber can be any type of explosive in a sufficient amount to create a supersonic detonation of the fuel; as for example 4 lbs. of Nitroguanidine are required to detonate 265 lbs. of Normal Propyl Nitrate (NPN). While both low or high brisance explosives can be used, the explosive Nitroguanidine, considered a borderline high brisance explosive, has been very successful. Any high explosive that has a shock output equivalent to 4 lbs. of Nitroguanidine will function with the presently used fuels and bomb containers. If the thickness of bomb wall 18 were increased, the same shocking effect could be achieved with a less amount of explosive.

The fuels which have been successfully used include Normal Propyl Nitrate (NPN), Ethyl Propyl Nitrate (EPN) and mixtures of both (58%–60% $C_2H_5NO_3$ and from 40%–42% $C_3H_7NO_3$). Any other liquid fuels of the class which are non-gaseous and stable at normal temperatures and pressures but when dispersed in the air become highly explosive could be used.

OPERATION

When the described bomb is mounted in a bomb rack, eyelet 46, through which arming lanyard 25 is threaded, is connected to the rack.

When the bomb rack is actuated to jettison the bomb, secured eyelet 46 pulls aft on lanyard 25, which is connected to slide pin 47 of fuse 28, and pulls pin 47, out of its propeller blocking position. Free fall of the bomb causes air driven propeller 48 of fuse 28 to spin. A predetermined number of propeller revolutions retracts a detonator holding screw within the fuse 28 and retraction of the screw permits a stab pin detonator to be spring rotated into alignment with an impact firing pin in the fuse. This completes safe arming of the fuse firing circuit after the bomb has left the carrier. Details in the construction of fuse 28 are not shown and are not considered necessary because they are well known to those familiar with this art, and the specifications for the M158 fuse are fully disclosed in Army Manual TO 11A-1-31 OP1664 (Vol. 2)-PP471–473. Furthermore, almost any type of military qualified proximity fuse can be used with this bomb, as previously explained.

As the bomb during its free fall approaches the target, fuse 28 makes target impact before housing 10 reaches the target proper. Impact of the fuse 28 forces the fuse firing pin into the stab detonator within the fuse. The detonator fires and sends an explosive shock wave along the prima cord 29 into the central burster charge in chamber 19 and fires that explosive.

Explosion energy is transmitted to the liquid fuel in chamber 20. The hydrostatic pressure generated by the central burster explosion ruptures and shatters the walls of both chambers 19 and 20, and disperses liquid fuel particles into the onrushing surrounding air. At the same time the shocking effect of the explosion energy begins to detonate the fuel, and as the fuel detonates, it expands the size of the exploding fuel until there is complete detonation of all the fuel. The time interval for detonation is approximiately 10 milliseconds as compared with ½ to 2 milliseconds for an H.E. bomb.

Tests show that complete detonation of the fuel generates a shock wave which produces an overpressure of 300 psi radially outward 10 feet from hardware impact point, 200 psi radially outward 20 feet, and 100 psi radially outward 30 feet.

Tests show that complete detonation of the fuel also generates an extremely high overpressure in a downward direction. Calibrated crush indicators, rupture discs, gauges, piezo-electric shock transducers, and other diagnostic equipment set in deep fox holes, covered bunker arrays, etc., have shown terminal effects equal to or greater than target damage at ground level and above. This extreme downwardly directed overpressure can only be explained by theory. The time interval of the overpressure is substantially greater than with conventional high explosive bombs, therefore the damage effect is greatly increased.

In summary, the above described invention provides a bomb which is so constructed that it utilizes a relatively safe, normally non-explosive, normally liquid, unpressurized rocket fuel to produce a long pulse highly destructive terminal effect on targets; a bomb which simultaneously forms and detonates fuel-air mixture under dynamic conditions without any terminal velocity limitations.

Having described the invention with sufficient clarity to enable those familiar with this art to construct and use it, we claim:

1. An aerial dropped FAE ordinance device comprising:

a fuel container;

a nitrated organic monopropellant liquid fuel filling the container;

explosive means integral with the container and fuel;

proximity fuse means supported on the container for detonating the explosive means in a dynamic environment;

said explosive means being of a sufficient energy level to disseminate the fuel into the dynamic atmospheric environment in the atomized form and to supersonically detonate the fuel in the atomized form from time zero with respect to the atomization thereof, thereby having no time delay between the atomization and detonation of the fuel.

2. An aerial dropped FAE ordinance as set forth in claim 1 wherein the liquid fuel is selected from the group consisting of ethyl nitrate, normal propyl nitrate, and a mixture of ethyl nitrate and normal propyl nitrate.

3. An aerial dropped FAE device as set forth in claim 1, wherein the fuel is Normal Propyl Nitrate.

4. An aerial dropped FAE device as set forth in claim 1, wherein the fuel is Ethyl Propyl Nitrate.

5. An aerial dropped FAE device as set forth in claim 1, wherein the explosive means is Nitroguanidine.

6. An aerial dropped FAE device as set forth in claim 1, wherein the fuel is a mixture of normal propyl nitrate and ethyl propyl nitrate.

7. A method of causing a fuel-air explosion comprising the steps of:

placing a container having therein a nitrated organic monopropellant liquid fuel, a proximity fuse and an explosive in a dynamic atmospheric environment;

shocking the fuel upon detonating the explosive with a sufficient energy level to thereby cause dispensing of the liquid fuel in an atomized form into the dynamic atmospheric environment and detonating the fuel in the atomized form from time zero with respect to the atomization thereof, thereby having no time delay between the atomization and detonation of the liquid fuel.

8. A method of creating a fuel-air explosion as set forth in claim 7, wherein the impact valocity of the confined quantity of fuel is no less than 450 FPS or greater than 1100 FPS.

9. A method of creating a fuel-air explosion as set forth in claim 7, wherein the confined quantity of fuel is gravity dropped in a bomb shaped container at impact velocities of no less than 400 FPS.

10. A method of creating a fuel-air explosion as set forth in claim 7, wherein the confined quantity of fuel is gravity dropped in a bomb shaped container at impact velocities of no less than 450 FPS, and the fuel is internally shocked by the explosive means which is centrally positioned within the container.

11. A method of creating a fuel-air explosion as set forth in claim 7, wherein the fuel is Normal Propyl Nitrate.

12. A method of creating a fuel-air explosion as set forth in claim 7, wherein said explosive means is ignited by a proximity fuse immediately above the target.

13. A method of creating a fuel-air explosion as set forth in claim 7, wherein said explosive means is Nitroguanidine.

* * * * *